US009820555B2

(12) United States Patent
Beck

(10) Patent No.: US 9,820,555 B2
(45) Date of Patent: Nov. 21, 2017

(54) UNIVERSAL ADAPTER SYSTEM FOR LOAD BEARING PACKS

(71) Applicant: TYR TACTICAL, LLC, Peoria, AZ (US)

(72) Inventor: Jason Beck, Peoria, AZ (US)

(73) Assignee: Tyr Tactical, LLC, Peoria, AZ (US)

( * ) Notice: Subject to any disclaimer, the term of this patent is extended or adjusted under 35 U.S.C. 154(b) by 0 days.

(21) Appl. No.: 14/708,381

(22) Filed: May 11, 2015

(65) Prior Publication Data

US 2015/0320182 A1 Nov. 12, 2015

Related U.S. Application Data

(60) Provisional application No. 61/992,116, filed on May 12, 2014.

(51) Int. Cl.

| | |
|---|---|
| ***A45F 3/04*** | (2006.01) |
| ***A44B 13/02*** | (2006.01) |
| ***A44B 13/00*** | (2006.01) |
| ***A41F 17/00*** | (2006.01) |
| ***A41D 13/05*** | (2006.01) |
| ***A45F 3/06*** | (2006.01) |
| ***A45F 3/14*** | (2006.01) |
| *A45F 3/00* | (2006.01) |

(52) U.S. Cl.

CPC ..... *A45F 3/04* (2013.01); *A41D 13/0518* (2013.01); *A41F 17/00* (2013.01); *A44B 13/0029* (2013.01); *A44B 13/02* (2013.01); *A45F 3/06* (2013.01); *A45F 3/14* (2013.01); *A45F 2003/001* (2013.01); *A45F 2003/045* (2013.01); *Y10T 24/45681* (2015.01); *Y10T 24/45696* (2015.01); *Y10T 29/49828* (2015.01); *Y10T 29/49829* (2015.01)

(58) Field of Classification Search

CPC ..... A45F 3/04; A45F 3/06; A45F 3/14; A45F 2003/001; A45F 2003/045; A41D 13/0518; A41F 17/00; A44B 13/02; A44B 13/0029; Y10T 24/45681; Y10T 24/45696; Y10T 24/49828; Y10T 24/49829

USPC ..... 24/644; 224/197, 271, 637, 665

See application file for complete search history.

(56) References Cited

U.S. PATENT DOCUMENTS 5,201,858 A * 4/1993 Otrusina ..... A45F 5/02 224/197
5,604,958 A * 2/1997 Anscher ..... A45C 7/0086 224/197
5,609,278 A * 3/1997 Fresco ..... A45C 5/14 224/153
5,622,296 A * 4/1997 Pirhonen ..... A45F 5/02 224/197

(Continued)

FOREIGN PATENT DOCUMENTS

WO WO9820772 5/1998

OTHER PUBLICATIONS

Extended Search Report issued Oct. 7, 2015 in corresponding European Application No. 15167421.5, 7 pages.

*Primary Examiner* — Peter Helvey
(74) *Attorney, Agent, or Firm* — Polsinelli PC

(57) ABSTRACT

Embodiments of universal adapter system including a belt adapter for a belt, such as a tactical belt, configured to couple one or more pack adapters secured to a respective load bearing pack, such as a backpack. Other embodiments of the universal adapter systems may be described and claimed.

3 Claims, 9 Drawing Sheets

(56) References Cited

U.S. PATENT DOCUMENTS

| | | | | | |
|---|---|---|---|---|---|
| 5,730,342 | A * | 3/1998 | Tien | A45F 5/02 | 224/197 |
| 5,806,741 | A * | 9/1998 | Kirk | A45F 5/00 | 224/634 |
| 5,954,250 | A * | 9/1999 | Hall | A45F 3/047 | 224/262 |
| 6,079,602 | A * | 6/2000 | Howell | A45F 3/047 | 224/262 |
| 6,321,959 | B1 * | 11/2001 | Howell | A45F 3/047 | 224/262 |
| 7,337,935 | B1 | 3/2008 | Glanville | | |
| 8,857,681 | B2 * | 10/2014 | Burnett | A44B 11/005 | 224/197 |
| 9,200,871 | B2 * | 12/2015 | Hexels | A45F 3/06 | |
| 9,220,333 | B2 * | 12/2015 | Losos | A45F 3/10 | |
| 9,332,821 | B2 * | 5/2016 | Janssen | A45F 3/04 | |

* cited by examiner

UNIVERSAL ADAPTER SYSTEM FOR LOAD BEARING PACKS

CROSS REFERENCE TO RELATED APPLICATIONS

This is a non-provisional application that claims benefit to U.S. provisional application Ser. No. 61/992,116 filed on May 12, 2014, and is herein incorporated by reference in its entirety.

FIELD

The present document relates generally to systems and methods for a universal adapter system having modular components that operatively couple a base belt to different types of load-bearing packs, and in particular, to a universal adapter system having an adapter component that is adapted to be coupled to different types of receiver components and is capable of a compensating action whenever a shift in load occurs by an individual wearing the base belt.

BACKGROUND

Many different types of tactical belts are worn by military personnel to provide a platform that allows various types of accessories, such as holsters and weapons, to be easily attached or detached for use by the individual. In some embodiments, the tactical base belt worn by an individual may be designed to have a receiver that mounts onto an adapter coupled to a protective vest and/or a load-bearing pack, for example a backpack, such that the individual may comfortably wear the protective vest and/or carry the backpack over long distances and over hostile terrain.

There are many manufacturers that design and manufacture various types of backpacks, protective vests and other load-bearing packs or tactical wear designed for different types of tactical missions or purposes. As such, one type of backpack or protective vest from one manufacturer may be needed for a particular phase of a mission, while another type of backpack or protective vest from another manufacturer is required for a different phase of the mission. Unfortunately, the multitude of different tactical base belts in combination with the different types of backpacks and other load-bearing packs or tactical wear available in the market may make it difficult to find one kind of backpack or protective vest that is compatible for engagement and mounting with a particular type of tactical base belt since different types of backpacks and/or protective vests from one or more manufacturers may not have an adapter arrangement that is compatible for mounting with a particular type of tactical base belt from a different manufacturer.

BRIEF DESCRIPTION OF THE DRAWINGS

Corresponding reference characters indicate corresponding respective elements among the views of the drawings. The headings used in the figures should not be interpreted to limit the scope of the claims.

DESCRIPTION

As described herein, embodiments of a universal adapter system provide a mechanical mounting arrangement for securing various types of load-bearing packs or tactical wear to a base belt, such as a tactical belt worn by an individual. In general, the universal adapter system allows different types of load-bearing packs or tactical wear to be mounted to the same type of base belt regardless of the fact that each of the load-bearing packs and/or tactical wear may be from different manufacturers and incompatible for mounting with a particular base belt made from another manufacturer. In one aspect, the universal adapter system includes an adapter component configured to be secured to a load carrier in which the adapter component is specifically configured to engage a corresponding receiver component secured to the base belt for allowing various types of load carriers to be mounted directly to the same type of base belt. In addition, the adapter component is configured to be mechanically coupled to the receiver component to allow a sliding and/or twisting action between the receiver component and the adapter component to compensate for any shift in load that occurs during movement of the individual.

Figure 1:
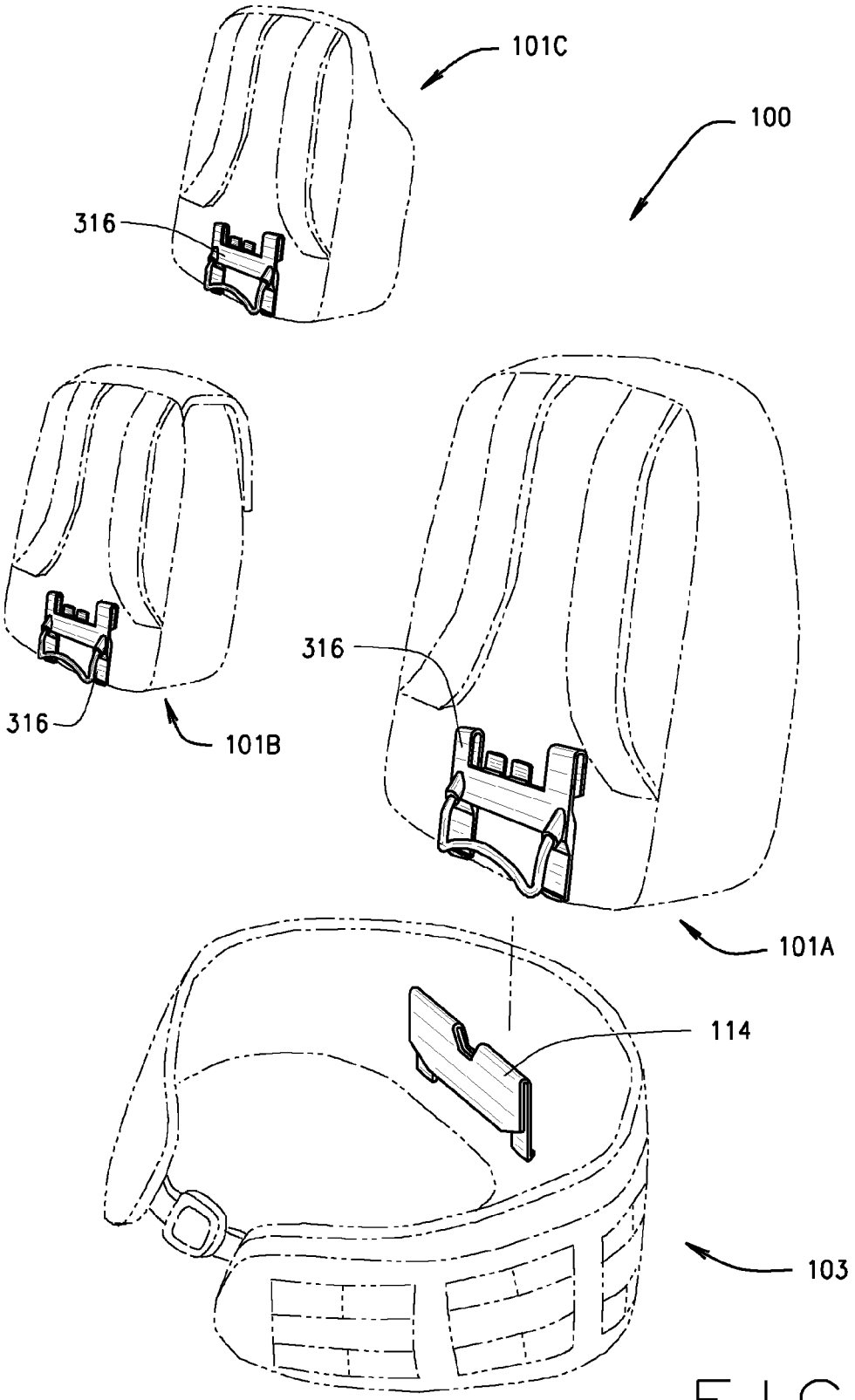
FIG. 1 is a perspective view of an embodiment of a universal adapter system illustrated in FIGS. 6-20 showing different types of backpacks (shown in phantom) secured to a universal adapter component configured to be engaged and disengaged from a receiver component secured to a base belt (shown in phantom)

Referring to the drawings, embodiments of a universal adapter system are illustrated and generally indicated as 100, 200, and 300 in FIGS. 1-20. Referring to FIG. 1, a first embodiment of a universal adapter system, designated 100, includes a receiver component 114 secured to a base belt 103 worn by an individual in which the receiver component 114 is configured to engage and disengage from an adapter component 316 for allowing different types of backpacks 101 to be secured to the same type of base belt 103. For example, as shown in FIG. 1, the receiver component 114 secured to base belt 103 may be engaged to a respective adapter component 316 secured to different types of backpacks 101A, 101B and 101C, thereby allowing the base belt 103 to mount different types of backpacks 101A, 101B, and 101C. The universal adapter systems 100, 200, and 300, include the same universal adapter component 316 that is configured to be mechanically coupled to different types of receiver components 114, 214 and 314 as shall be described in greater detail below. In some embodiments, the base belt 103 may be a tactical-type belt configured to be worn around the waist of an individual, although other types of belts are contemplated.

Figure 2:
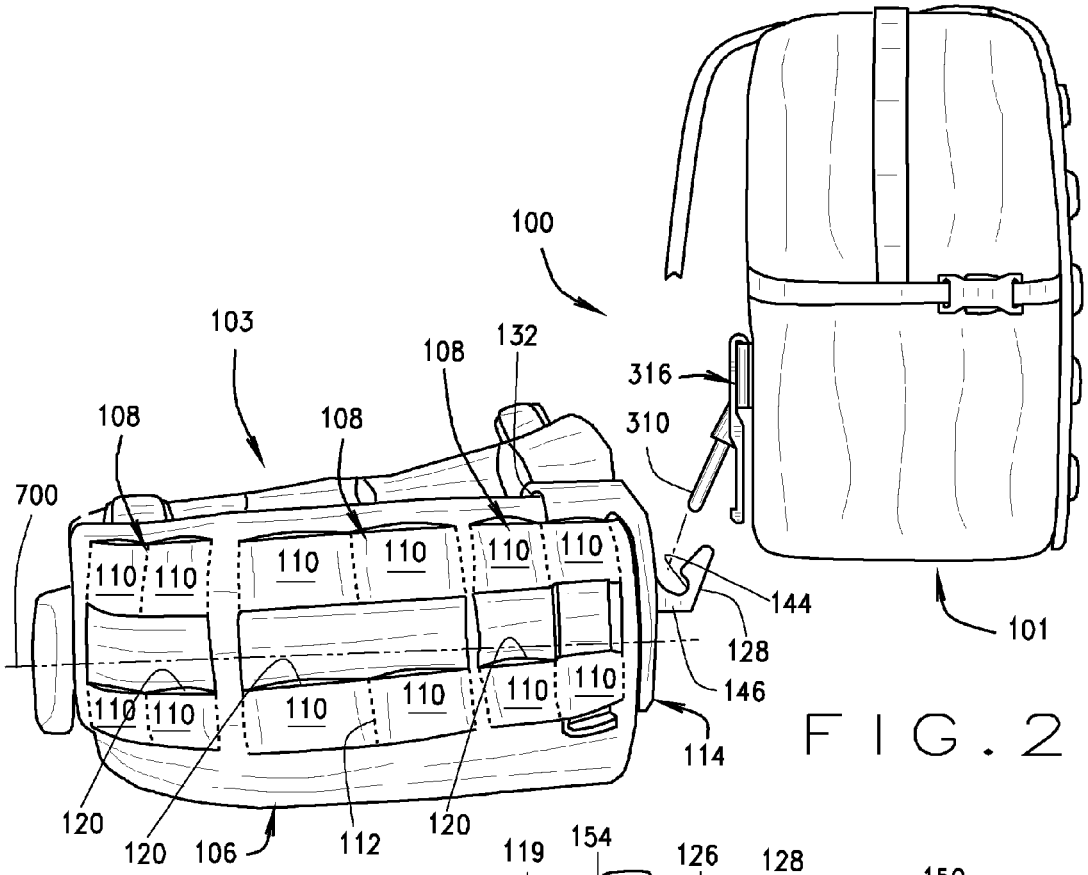
FIG. 2 is a side view of another embodiment of the universal adapter system showing another type of receiver component secured to a base belt configured to be engaged and disengaged from the adapter component of FIG. 1 secured to a backpack.
Figure 3:
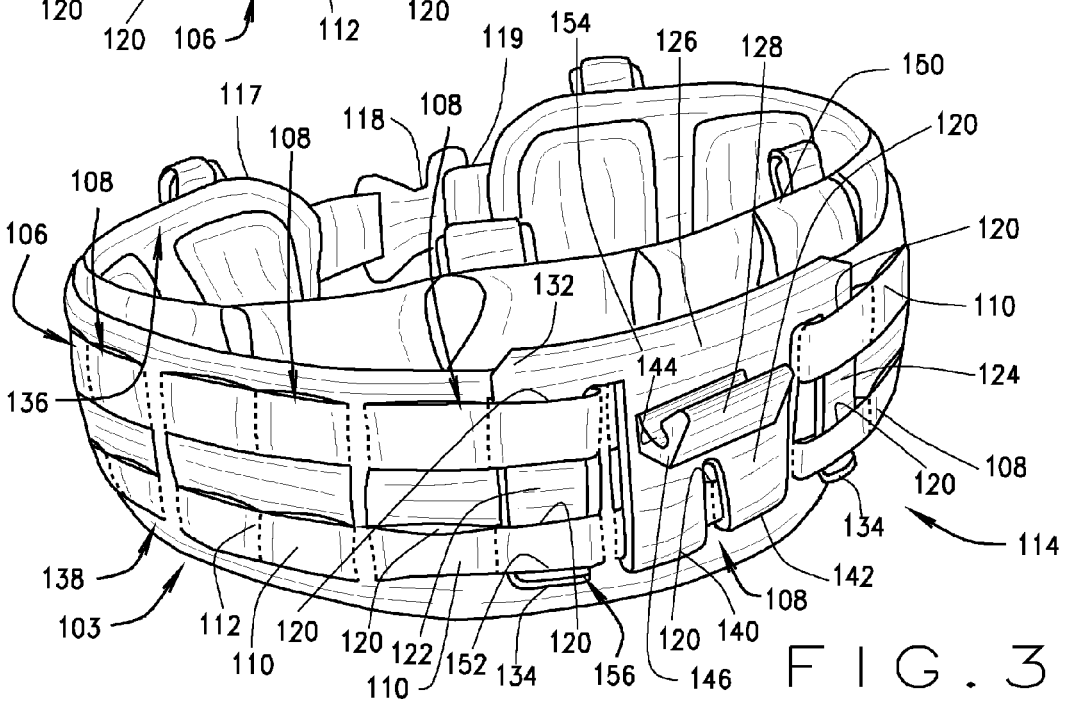
FIG. 3 is a perspective view of the base belt showing the receiver component for the universal adapter system of FIG. 2.

Referring to FIGS. 2 and 3, as noted above universal adapter system 100 may include the receiver component 114 secured to base belt 103 and configured to be engaged and disengaged from a universal adapter component 316 secured to a load bearing pack 101. In some embodiments, the base belt 103 may include an the elongated belt body 106 that defines an inner surface 136 and an outer surface 138 forming a first end 117 and a second end 119 that are secured together with a conventional buckle 118 as shown in FIG. 3.

In some embodiments, the elongated belt body 106 may include one or more webbing sections 108 secured to the outer surface 138 of the belt body 106 with each webbing section 108 having one or more horizontal bands 110 sewn to the outside surface 138 of the belt body 106 through stitching lines 112. In addition, each band 110 may extend in substantial parallel orientation relative to the longitudinal axis 700 of the belt body 106 with each band 110 defining a vertically-oriented channel 120 formed between a respective band 110 and the outer surface 138 of the belt body 106. In some embodiments, the bands 110 may be formed integral with the material of the belt body 106.

In some embodiments, the receiver component 114 that is secured to the elongated belt body 106 may define a middle portion 126 formed between first and second side portions 122 and 124 that collectively extend in parallel orientation relative to the middle portion 126. In some embodiments, the middle portion 126, first side portion 122 and second side portion 124 are configured to be inserted through the channels 120 of respective bands 110 located around the elongated belt body 106 of the base belt 103 when securing the receiver component 114 to the elongated belt body 106. In some embodiments, the middle portion 126 may further define first and second retention arms 140 and 142 each configured to extend through a respective channel 120 formed by the bands 110 to further secure the receiver component 114 to the belt body 106 of the base belt 103.

In some embodiments, as shown in FIG. 2, the receiver component 114 includes a retention feature 128 that extends laterally outward from the middle portion 126, while the adapter component 316 includes a mounting bar 310 that is configured to be engaged or disengaged to or from the retention feature 128. In particular, the retention feature 128 of the receiver component 114 forms a first laterally-extending member 146 defining an open channel 144 which is configured to be mechanically coupled with the mounting bar 310 of the adapter component 316 In this mechanical coupling arrangement, the individual wearing the base belt 103 may engage or disengage the mounting bar 310 of the adapter component 316 from the retention feature 128 of the receiver component 114 using either a hands-free or single-handed operation by the individual. It is this compatible structural interaction between the receiver component 114 and the adapter component 316 that provides a universal system of engagement where one type of base belt 103 may be coupled to different types of backpacks 101A, 101B, and 101C secured to a respective adapter component 316 configured to be engaged and disengaged relative to the receiver component 114.

As shown in FIG. 3, in some embodiments the receiver component 114 defines an upper retention portion 132 formed along an upper portion 154 of the receiver component 114, which is configured to engage an upper edge 150 of the belt body 106 of the base belt 103 when securing the receiver component 114 to the base belt 103. In some embodiments, the receiver component 114 may define a lower retention portion 134 formed along the lower portion 156 of the receiver component 114, which is configured to engage the lower portion 156 of the receiver component 114 to a lower portion 152 of a respective band 110 of a particular webbing section 108 along the belt body 106.

Figure 4:
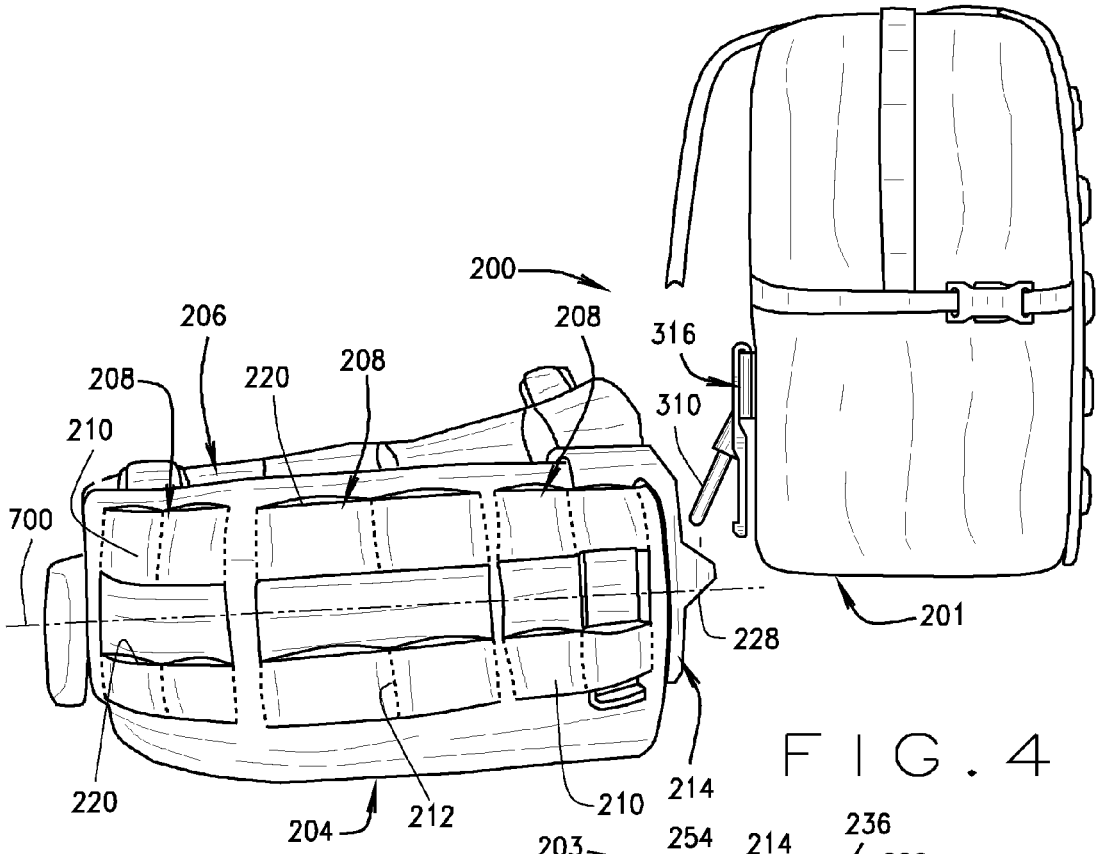
FIG. 4 is a side view of yet another embodiment of the universal adapter system showing a receiver component having a raised bridge portion configured to be engaged and disengaged from the adapter component of FIG. 1 secured to a backpack.
Figure 5:
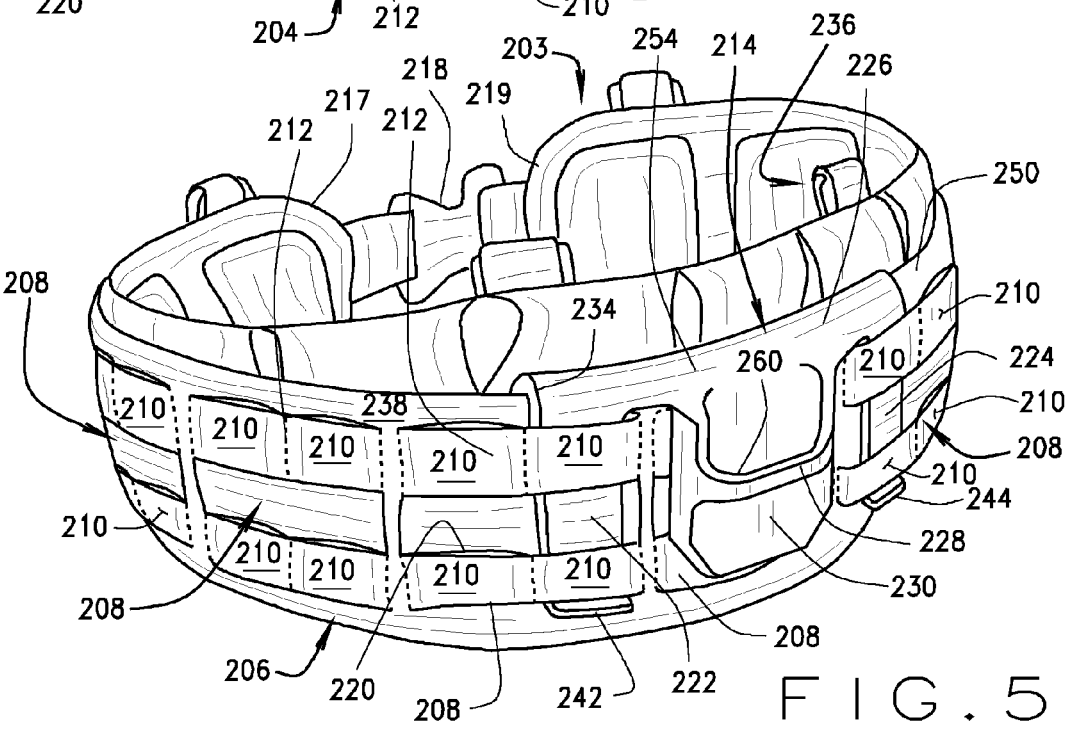
FIG. 5 is a perspective view of the receiver component secured to the base belt of the universal adapter system of FIG. 4.

In a second embodiment shown in FIGS. 4 and 5, a universal adapter system, designated 200, includes a differently configured receiver component 214 secured to the same type of base belt 203 as base belt 103 worn by an individual and specifically configured to engage the same type of adapter component 316, which is secured to a backpack 201 or other types of load-bearing packs for mounting to the base belt 203. Similar to belt body 106, belt body 206 defines an inner surface 236 and an outer surface 238 having a first end 217 and a second end 219 coupled together with a conventional buckle 218 as illustrated in FIG. 5.

Similarly, the belt body 206 may include a plurality of webbing sections 208 attached to the outer surface 238 of the belt body 206 with each webbing section 208 having one or more bands 210 sewn to the outside surface 238 of the base belt 204 through stitching lines 212. In addition, each band 210 may be formed in substantially parallel orientation relative to the longitudinal axis 700 of the belt body 206 with each band 210 defining a vertically-oriented channel 220 formed between the band 210 and the outer surface 238 of the belt body 206. In some embodiments, the bands 210 may be formed integral with the material of the belt body 206.

In some embodiments, the receiver component 214 may define a middle portion 226 formed between first and second side portions 222 and 224 each configured to be inserted through respective bands 210 when mounting the receiver component 214 to the base belt 203. In some embodiments, the middle portion 226 may include a raised bridge portion 228 configured to extend over a depression 230 formed within the middle portion 226 for collectively defining a slot 260. In some embodiments, the first side portion 222 may define a first retention arm 242 and the second side portion 224 may define a second retention arm 244. The first and second retention arms 242 and 244 may be configured to engage a lower portion of a respective band 210 for securing the receiver component 214 to the base belt 203. In some embodiments, the receiver component 214 may define a retention portion 234 formed along an upper portion 254 of the receiver component 214 which is configured to engage an upper edge 250 of the belt body 206 when securing the receiver component 214 to the base belt 204.

As shown in FIG. 4 and discussed above, the adapter component 316 may include a mounting bar 310 specifically configured to be secured to the raised bridge portion 228 of the receiver component 214 when engaging the adapter component 316 to the receiver component 214 as the backpack 201 is mounted to the base belt 203. In this mechanical coupling arrangement, the individual wearing the base belt 203 may engage or disengage the adapter component 316 from the receiver component 214 using either a hands-free or single-handed operation by the individual.

Figure 6:
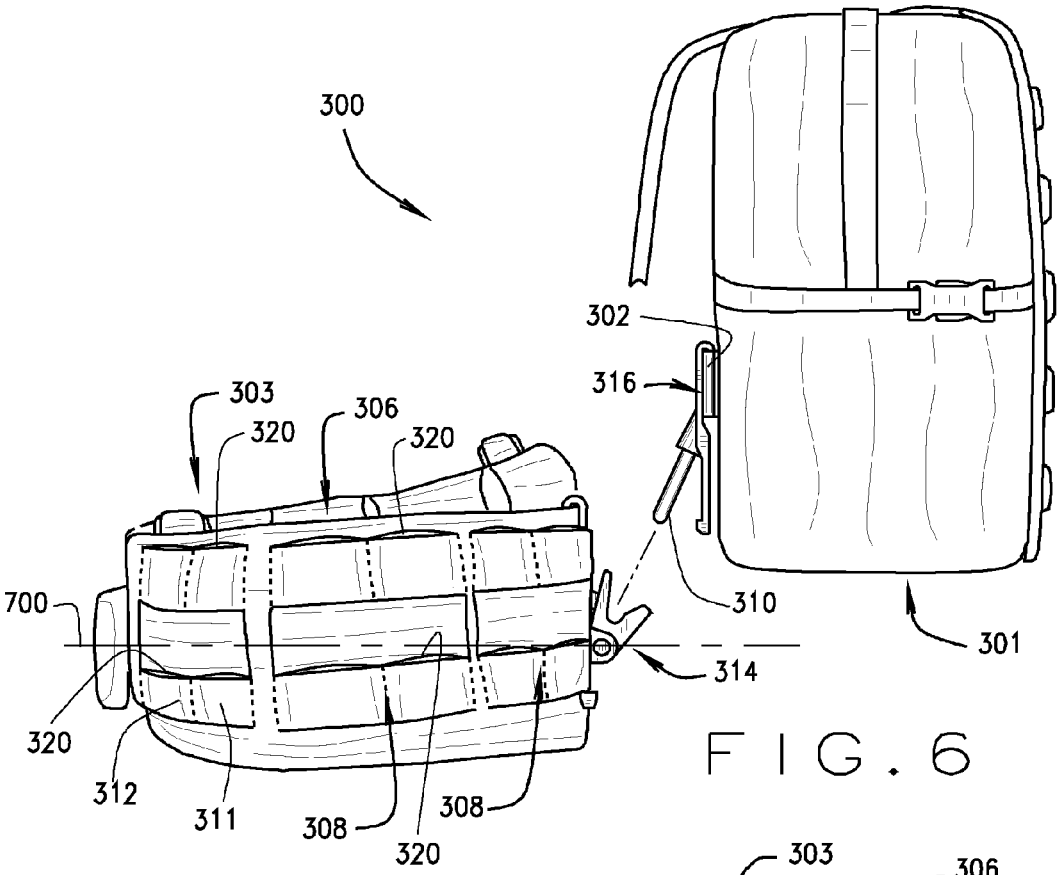
FIG. 6 is a side view of the universal adapter system of FIG. 1 showing the receiver component configured to be engaged or disengaged from the adapter component of FIG. 1 secured to a backpack.
Figure 7:
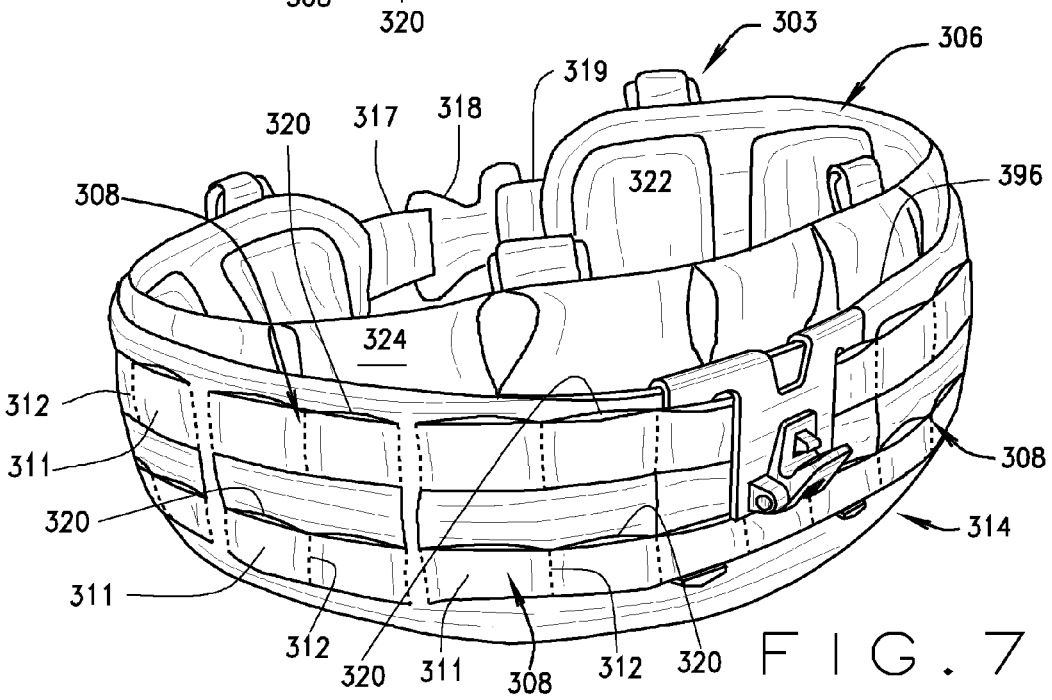
FIG. 7 is a perspective view of the receiver component secured to the base belt of the universal adapter system of FIG. 6.

In a third embodiment shown in FIGS. 6 and 7, a universal adapter system, designated 300, may include a differently configured receiver component 314 secured to a base belt 303 worn by an individual and specifically configured to engage the same type of universal adapter component 316 as described above, which is secured to webbing 302 of a backpack 301 or other types of load-bearing packs for coupling different types of backpacks 301 to the same type of base belt 303. Similar to belt body 106 and belt body 206, the belt body 306 defines an inner surface 322 and an outer surface 324 having a first end 317 and a second end 319 secured together with a conventional buckle 318 as shown in FIG. 7.

Similarly, the belt body 306 may also include a plurality of webbing sections 308 attached to the outer surface 324 of the belt body 306 with each webbing section 308 having one or more bands 311 sewn to the outside surface 324 of the belt 303 through sewn lines 312. In addition, each band 311 may be formed in substantially perpendicular orientation relative to the longitudinal axis 700 of the belt body 306 with each band 311 defining a vertically oriented channel 320 formed between the band 311 and the outer surface 324 of the belt body 306.

Figure 8:
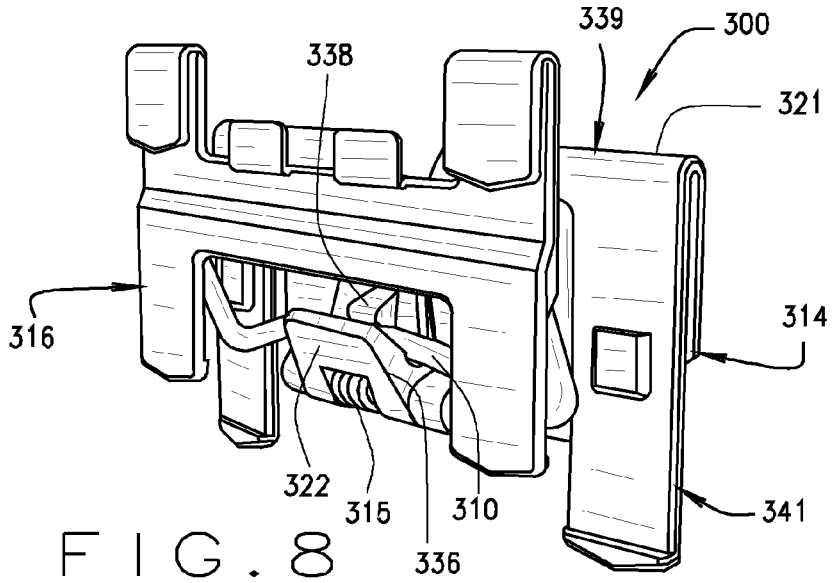
FIG. 8 is an assembled perspective view of the universal adapter system of FIG. 1.
Figure 9:
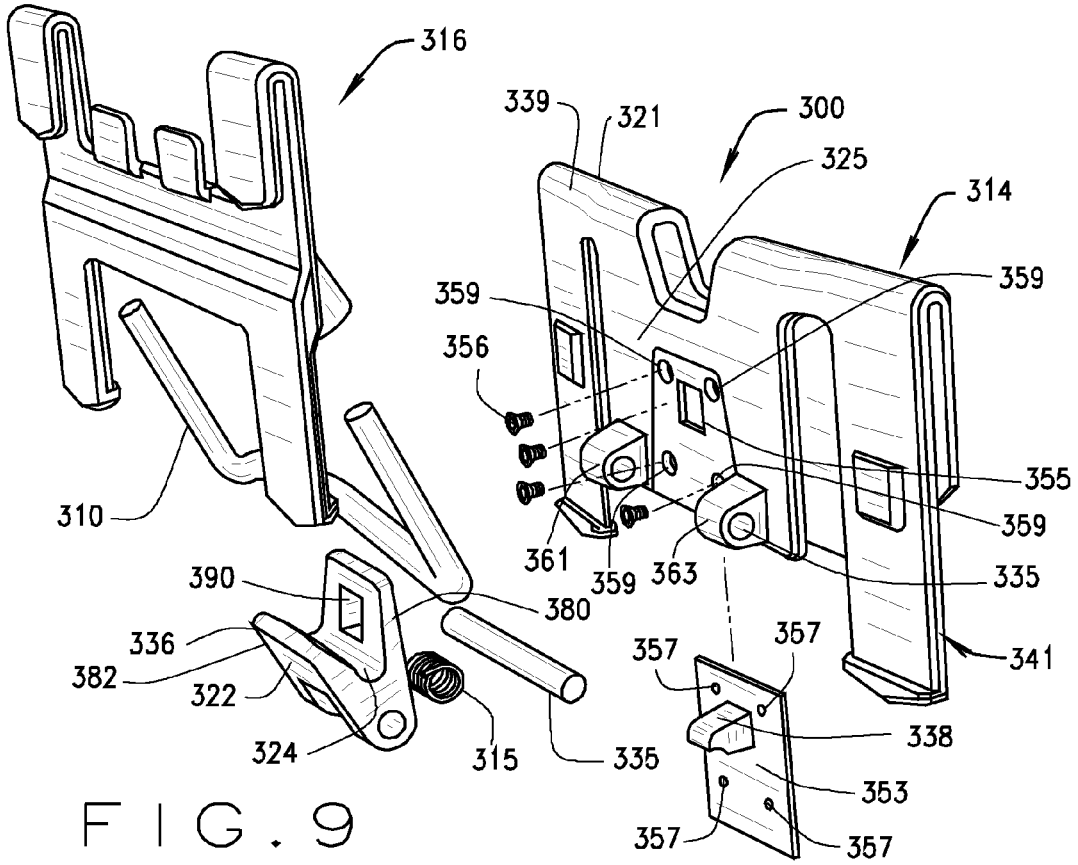
FIG. 9 is an exploded view of the universal adapter system of FIG. 1.

Referring to FIGS. 9-12, in some embodiments, the receiver component 314 may include a base portion 321 having a locking mechanism 322 for mechanically engaging and disengaging the receiver component 314 from the adapter component 316. As shown in FIGS. 8 and 9, the locking mechanism 322 includes a retention arm 338 that cooperates with a rotatable biased arm 336. The retention arm 338 and the rotatable biased arm 336 are operable to mechanically engage and disengage the adapter component 316 relative to the receiver component 314. In particular, the rotatable biased arm 336 is operative to rotate between an open position (FIG. 16) in which the adapter component 316 may be allowed to engage or disengage relative to the receiver component 314 and a closed position (FIG. 17) in which the adapter component 316 is secured to the receiver component 314. In some embodiments, the engagement and disengagement of the universal adapter system 300 is a "click-in" or "click-out" operation to engage or disengage the adapter component 316 from the receiver component 314 in either a hands-free or one handed operation by the individual wearing the base belt 303 as shall be discussed in greater detail below.

Figure 10:
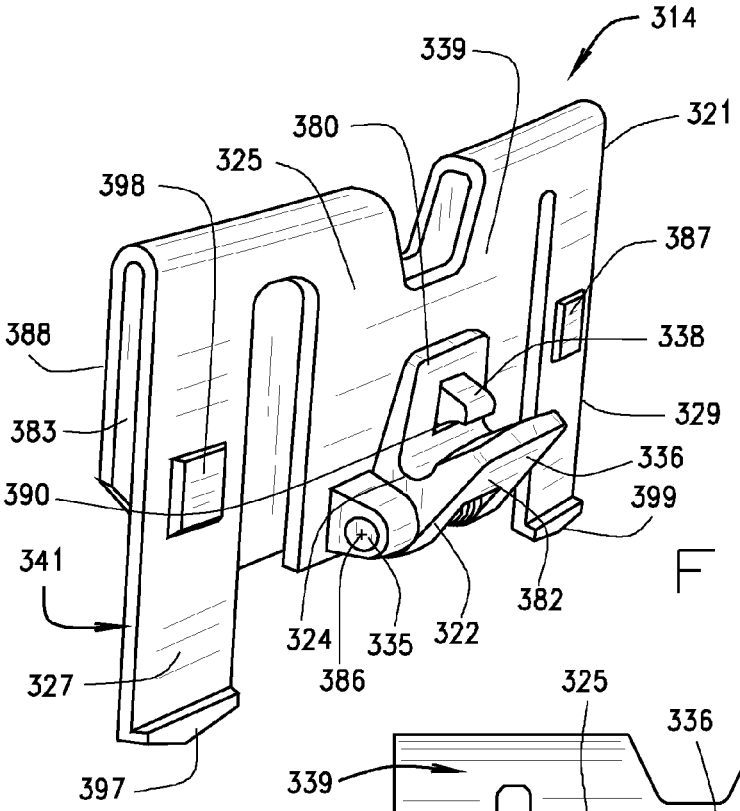
FIG. 10 is a perspective view of the receiver component of FIG. 1.
Figure 11:
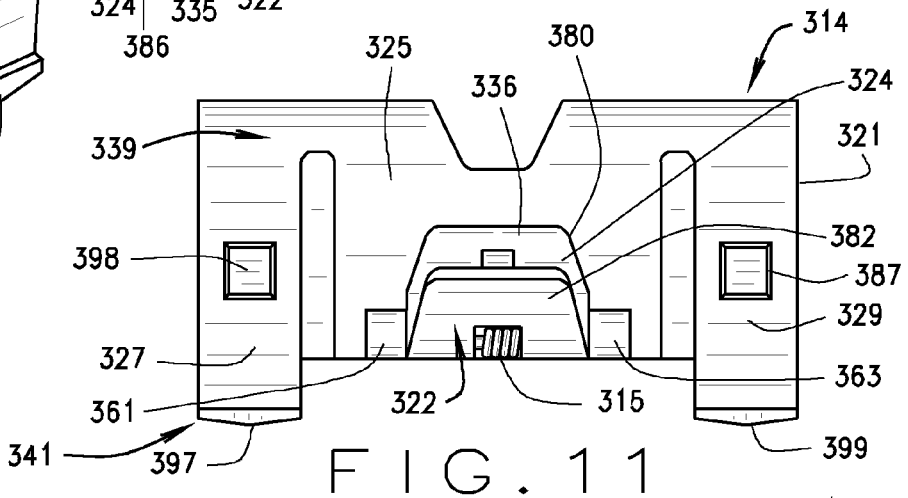
FIG. 11 is a front view of the receiver component of FIG. 1.
Figure 12:
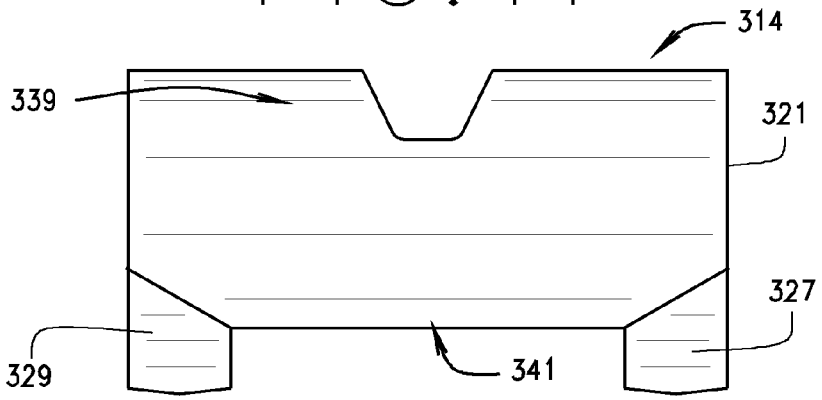
FIG. 12 is a rear view of the receiver component of FIG. 1.

As shown in FIGS. 10-12, the base portion 321 of the receiver component 314 defines a middle arm 325 having a first side arm 327 defined on one side of the middle arm 325 and a second side arm 329 defined on an opposite side of the middle arm 325 that collectively form an upper portion 339 and a lower portion 341 of the receiver component 314. In some embodiments, the lower portion 341 of the middle arm 325 includes a first mounting member 361 and an opposite second mounting member 363 that each define a respective channel configured to receive respective ends of a bar 335 (FIGS. 9 and 10), which allows the rotatable biased arm 336 to rotate about the bar 335 at pivot point 386 (FIG. 10) such that the rotatable biased arm 336 may rotate between the open and closed positions described above. As shown in FIG. 9, a recess 355 is formed between the first mounting member 361 and the second mounting member 363 of the middle arm 325 and defines a first plurality of openings 359 that are arranged to be aligned with a second plurality of openings 357 formed along a plate 353 secured behind the middle portion 325 of the base portion 321 for receiving securing members 356 that secure the plate 353 behind the recess 355. In this arrangement, the retention arm 338 extends outwardly from the plate 353 and through the base portion 321 in a fixed position relative to the rotatable biased arm 336 as illustrated in FIG. 10.

As shown in FIGS. 7, 10 and 11, in some embodiments the first side arm 327 may define a lower retention portion 397 and an upper retention portion 398, while the second side arm 329 also defines a lower retention portion 399 and an upper retention portion 387, which are each configured to engage respective channels 320 defined along one or more of webbing portions 308 to secure the receiver component 314 to the base belt 303. In some embodiments, the base portion 321 of the receiver component 314 may define any combination of lower and upper retention portions 387, 397, 398 and 399 to secure the receiver component 314 to the base belt 303. In some embodiments as shown in FIG. 10, the receiver component 314 may include a retainer portion 388 that defines an arm forming a slot 383 to couple the receiver component 314 to an upper edge 396 of the base belt 303 as shown in FIG. 7.

Figure 17:
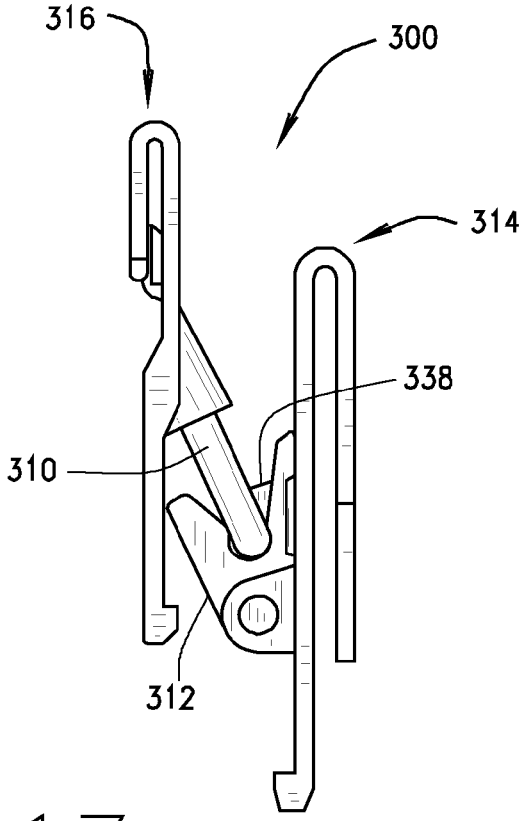
FIG. 17 is a side view of the adapter component after engagement with the receiver component for the universal adapter system of FIG. 8.

As further shown in FIGS. 8-11 and 17 the rotatable biased arm 336 forms a first raised portion 380 and a second raised portion 382 that collectively form a channel 324 configured to receive the mounting bar 310 of the adapter component 316 therein when securing the receiver component 314 to the adapter component 316 as specifically shown in FIGS. 8 and 17. As illustrated in FIG. 9, a passage 390 is formed through first raised portion 380 and communicates with and is in perpendicular orientation relative to the channel 324 defined by the rotatable biased arm 336. The passage 390 is configured to permit the retention arm 338 to extend outwardly through the first raised portion 380 to block access to the channel 324, thereby preventing the mounting bar 310 from disengaging from the channel 324 of the rotatable biased arm 336 when the locking mechanism 322 is in the closed position (FIGS. 8 and 17).

Figure 16:
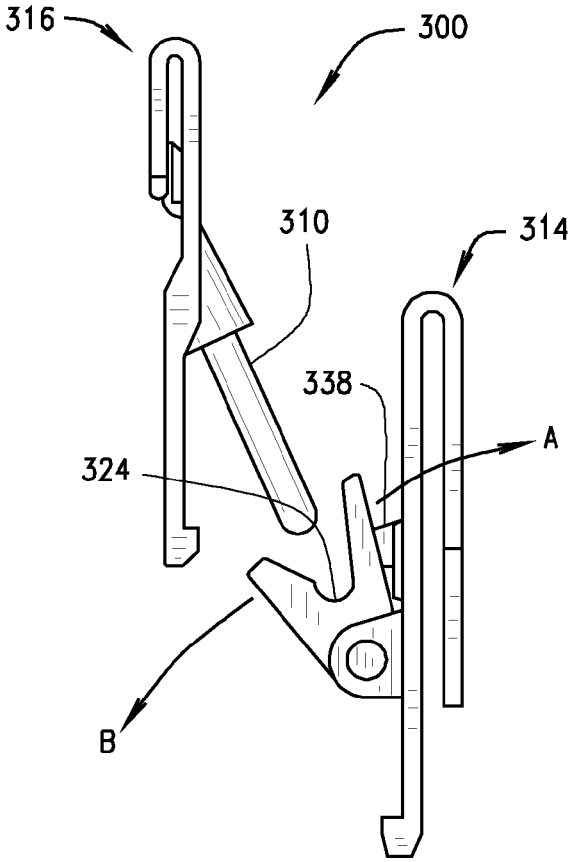
FIG. 16 is a side view of the adapter component prior to engagement with the receiver component for the universal adapter system of FIG. 8.

As further shown in FIGS. 8, 9 and 11, the receiver component 314 includes a spring 315 that applies a bias to the rotatable biased arm 336 in direction A (FIG. 16) to bias the rotatable biased arm 336 to a normally-closed position (FIG. 17) such that the retention arm 338 extends outwardly through the passage 390 to block access with the channel 324 of the rotatable biased arm 336. When the adapter component 316 is engaged to the receiver component 314, the mounting member 310 of the adapter component 316 is prevented from disengagement from the rotatable biased arm 336 by the retention arm 338. Conversely, as shown in FIG. 16 rotation of the rotatable biased arm 336 in direction B moves the rotatable biased arm 336 from the closed position (FIG. 17) to the open position (FIG. 16) such that the retention arm 338 becomes recessed within the passage 390 and no longer blocks the channel 324, thereby allowing the mounting bar 310 to be disengaged from the rotatable biased arm 336.

Figure 13:
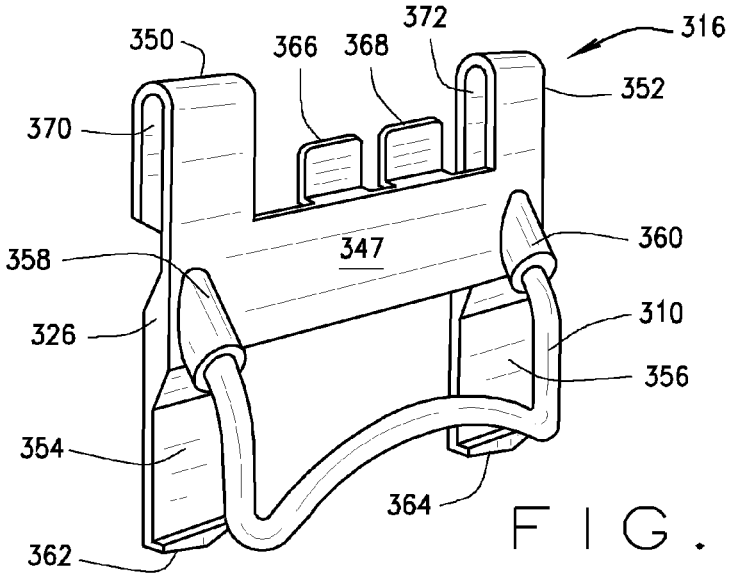
FIG. 13 is a perspective view of the receiver component of FIG. 1.
Figure 14:
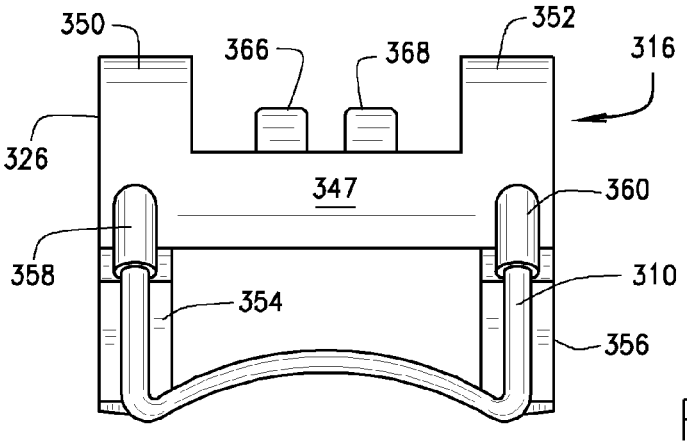
FIG. 14 is a front view of the adapter component of FIG. 1.
Figure 15:
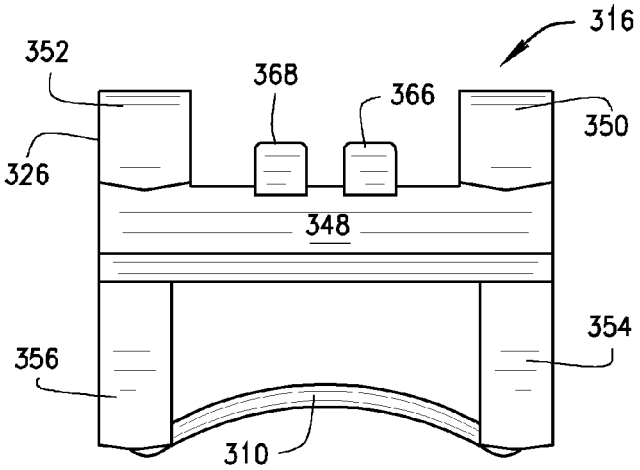
FIG. 15 is a rear view of the adapter component of FIG. 1.

Referring to FIGS. 13-15, in some embodiments the adapter component 316 may include a mounting body 326 configured to be mounted to webbing sections of the backpack 301 (FIGS. 1 and 6). The mounting body 326 defines a front surface 347 and a rear surface 348 that collectively form a first arm portion 350, a second arm portion 352, a first leg portion 354 and a second leg portion 356. In addition, the front surface 347 defines first and second sockets 358 and 360 each configured to securely engage respective ends of the mounting rod 310.

As shown in FIG. 13, the first arm portion 350 of the mounting body 326 defines a slot 370, while the second arm portion 352 defines a slot 372 which are configured to engage the adapter component 316 to the load bearing pack 301. In addition, first and second tab portions 366 and 368 provide an additional backing structure that extends outwardly from the mounting body 326 and in parallel orientation relative to the first and second arm portions 350 and 352 as shown in FIGS. 13-15. As shown in FIG. 7, the first and second tab portions 366 and 368 may engage webbing 302 of the backpack 301 when securing the adapter component 316 to the backpack 301. Referring to FIG. 13, the first leg portion 354 may define a tang 362 at the free end thereof, while the second leg portion 356 may define a tang 364 at the thereof in which the tangs 362 and 364 provide a retention surface for engaging the edge of the webbing of the backpack 301.

Figure 18:
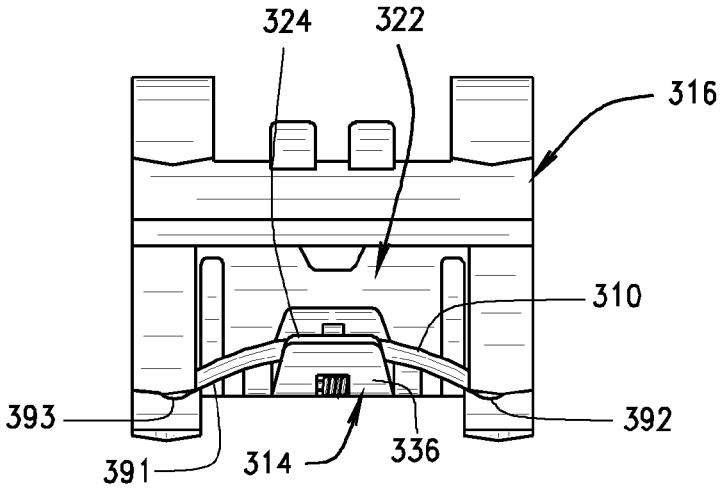
FIG. 18 is an isolated front view for the universal adapter system of FIG. 8 showing the adapter component coupled to the receiver component when mounting the backpack to the base belt.
Figure 19:
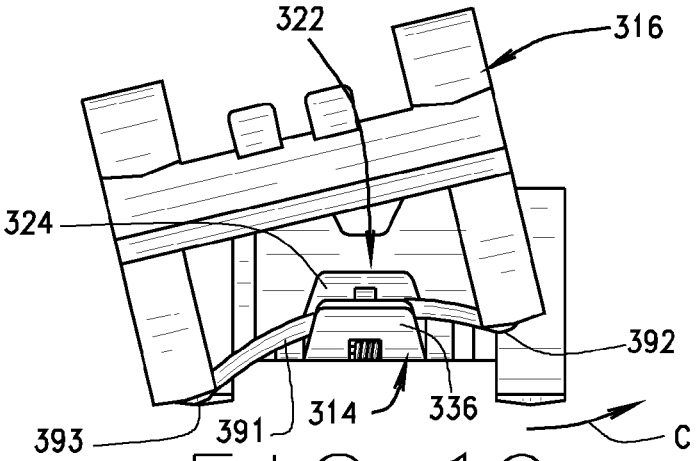
FIG. 19 is an isolated front view for the universal adapter system of FIG. 8 showing the sliding action of the adapter component relative to the receiver component in one direction when a shift in load occurs.
Figure 20:
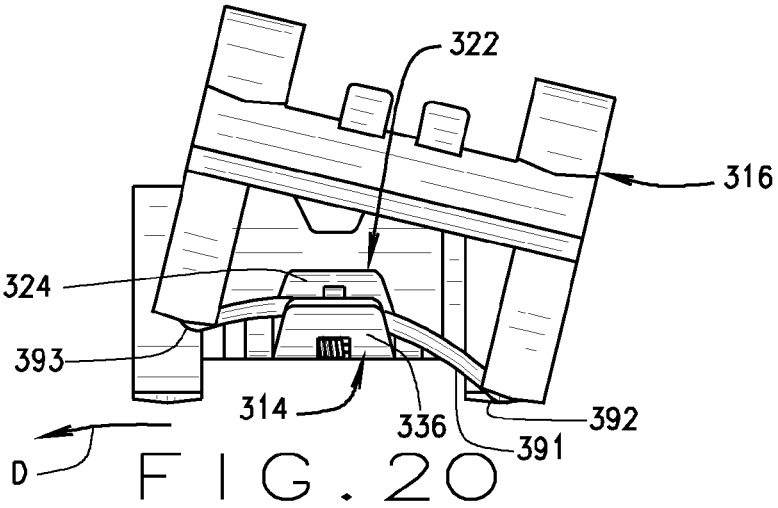
FIG. 20 is an isolated front view for the universal adapter system of FIG. 8 showing the sliding action of the adapter component relative to the receiver component in an opposite direction when a shift in load occurs.

In some embodiments, the universal adapter systems 100, 200 and 300 may interact with respective load bearing packs 101, 201 and 301 as a means for compensating in any shift in load when the individual assumes a different body position. Using universal adapter system 300 as an example, as shown in FIG. 18 the rotatable biased arm 336 may be in contact between the first and second ends 392 and 393 of the curved portion 391 of the mounting bar 310 when there is no shift in load, such as when the individual is stationary and/or in a substantially upright position. As illustrated in FIG. 19, movement of the individual in a particular direction and/or the individual assuming a particular body position that causes a shift in load may be compensated by adapter component 316 through a sliding action of the mounting bar 310 in direction C along the channel 324 of the locking mechanism 322. As illustrated in FIG. 20, movement of the individual in an opposite direction or the individual assuming another body position that causes a shift in load that may also be compensated through a sliding action of the mounting bar 310 in an opposite direction D along the channel 324 of the locking mechanism 322. In this manner, any shift in load that occurs is compensated through sliding action of the mounting bar 310 along the channel 324 of the receiver component 314. In addition to a sliding action that compensates for any shift in load when the individual assumes a different body position, the mounting bar 310 may also move in a twisting action relative to channel 324. In some embodiments, the twisting and/or sliding actions of the mounting bar 310 may also result in the mounting bar 310 becoming disengaged from the channel 324 of the rotatable biased arm 336 of the receiver component 314. For example, a sliding action between the adapter component 316 and the receiver component 314 where either the first or second ends 392 and 393 of the mounting bar 310 contacts the channel 324 can cause the mounting bar 310 to disengage from the rotatable biased arm 336. This same disengagement feature also applies to universal adapter systems 100 and 200.

In one aspect of the universal adapter systems 100, 200 and 300, the individual may either engage or disengage the adapter components 116, 216, 316 from the respective receiver components 114, 214, 314 in a hands-free operation while the individual is wearing respective base belts 103, 203, 303 and the backpacks 101, 201, 301 are mounted to respective base belts 103, 203, 303. In another aspect, the universal adapter systems 100, 200 and 300 allow the individual to either engage or disengage the adapter components 116, 216, 316 from the respective receiver components 114, 214, 314 in a one-handed operation while the individual is wearing the respective base belts 103, 203, 303 and the backpacks 101, 201, 301 are mounted to respective base belts 103, 203, 303.

In some embodiments, the universal adapter systems 100, 200, 300 comprise modular components that are secured to respective load bearing packs, dynamic load carriage apparatuses, protective vests, and tactical belts and may be interchanged for other embodiments of the universal adapter systems 100, 200, 300 In some embodiments, the universal adapter systems 100, 200, 300 comprise integral components that are permanently engaged to respective load bearing packs, dynamic load carriage apparatuses, protective vests, and tactical belts during manufacture.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. A universal adapter system comprising:

a base portion having a surface;

a retention arm extending outwardly from the surface of the base portion;

a biased arm mounted to the surface of the base portion, the biased arm having a first raised portion and a second raised portion, the biased arm movable between an open position and a closed position;

a channel defined in the biased arm and disposed between the first raised portion and the second raised portion, the channel configured to receive a mounting bar of an adapter component engaged to a load; and a passage through the first raised portion, the retention arm extending through the passage and locking the mounting bar in the channel when the biased arm is in the closed position, the mounting bar displaceable within the channel in the closed position in response to a shift in the load.

2. The universal adapter system of claim 1, wherein the base portion is engaged to a belt.

3. The universal adapter system of claim 1, wherein the mounting bar displaces within the channel through at least one of a sliding action or a twisting action.

* * * * *